US010765912B2

(12) United States Patent
Summers

(10) Patent No.: US 10,765,912 B2
(45) Date of Patent: Sep. 8, 2020

(54) EXERCISE APPARATUS

(71) Applicant: ENANEF LIMITED, Abinger Bottom (GB)

(72) Inventor: Neil Summers, Abinger Bottom (GB)

(73) Assignee: ENANEF LIMITED, Abinger Bottom, Dorking (GB)

( * ) Notice: Subject to any disclaimer, the term of this patent is extended or adjusted under 35 U.S.C. 154(b) by 35 days.

(21) Appl. No.: 16/085,538

(22) PCT Filed: Mar. 16, 2017

(86) PCT No.: PCT/GB2017/050727
§ 371 (c)(1),
(2) Date: Sep. 14, 2018

(87) PCT Pub. No.: WO2017/158362
PCT Pub. Date: Sep. 21, 2017

(65) Prior Publication Data

US 2019/0151709 A1 May 23, 2019

(30) Foreign Application Priority Data

Mar. 17, 2016 (GB) ..... 1604565.0

(51) Int. Cl.
*A63B 23/035* (2006.01)
*A63B 21/04* (2006.01)
(Continued)

(52) U.S. Cl.
CPC .... *A63B 23/03541* (2013.01); *A63B 21/0442* (2013.01); *A63B 21/0552* (2013.01);
(Continued)

(58) Field of Classification Search
CPC ..... A63B 21/015; A63B 21/02; A63B 21/026; A63B 21/0442; A63B 21/045;
(Continued)

(56) References Cited

U.S. PATENT DOCUMENTS 5,637,062 A * 6/1997 Schmittner ..... A63B 21/00065 482/130
7,419,459 B2 * 9/2008 Van Straaten ..... A63B 22/14 482/146
(Continued)

FOREIGN PATENT DOCUMENTS

| | | |
|---|---|---|
| EP | 1878476 A1 | 1/2008 |
| EP | 2281609 A1 | 2/2011 |
| GB | 3011754 | 3/2003 |

OTHER PUBLICATIONS

International Search Report for PCT/GB2017/050727 dated May 16, 2017.
(Continued)

*Primary Examiner* — Megan Anderson
(74) *Attorney, Agent, or Firm* — Ladas & Parry, LLP

(57) ABSTRACT

The present invention provides for an exercise apparatus comprising a pair of footplates arranged for reciprocal movement on respective supports, the supports extending outwardly from either side of a central frame portion of the apparatus, the footplates being arranged to receive a pair of human feet and so as to be moved by a user in a reciprocal manner in the direction of the supports as part of an exercise routine, and wherein the apparatus includes handgrip portions extending from the central frame portion of the apparatus, the handgrip portions being arranged for movement, such as for example upward and/or downward movement against a resilient bias during the exercise routine.

28 Claims, 6 Drawing Sheets

(51) Int. Cl.

| | |
|---|---|
| ***A63B 22/14*** | (2006.01) |
| ***A63B 23/04*** | (2006.01) |
| ***A63B 21/00*** | (2006.01) |
| ***A63B 22/00*** | (2006.01) |
| ***A63B 21/055*** | (2006.01) |
| *A63B 21/015* | (2006.01) |
| *A63B 21/02* | (2006.01) |
| *A63B 21/045* | (2006.01) |
| *A63B 22/20* | (2006.01) |
| *A63B 23/02* | (2006.01) |
| *A63B 23/00* | (2006.01) |

(52) U.S. Cl.

CPC ..... *A63B 21/4034* (2015.10); *A63B 21/4035* (2015.10); *A63B 21/4045* (2015.10); *A63B 22/0005* (2015.10); *A63B 22/14* (2013.01); *A63B 23/03525* (2013.01); *A63B 23/0417* (2013.01); *A63B 21/00043* (2013.01); *A63B 21/00065* (2013.01); *A63B 21/015* (2013.01); *A63B 21/02* (2013.01); *A63B 21/026* (2013.01); *A63B 21/045* (2013.01); *A63B 21/0557* (2013.01); *A63B 22/203* (2013.01); *A63B 23/0222* (2013.01); *A63B 23/0488* (2013.01); *A63B 2022/0028* (2013.01); *A63B 2022/0041* (2013.01); *A63B 2022/206* (2013.01); *A63B 2023/003* (2013.01)

(58) Field of Classification Search

CPC ..... A63B 21/052; A63B 21/0557; A63B 21/4045; A63B 21/4035; A63B 21/4034; A63B 22/0005; A63B 22/14; A63B 22/203

See application file for complete search history.

(56) References Cited

U.S. PATENT DOCUMENTS

| | | | | |
|---|---|---|---|---|
| 7,846,073 | B2 * | 12/2010 | Summers | A63B 21/0603 482/135 |
| 9,421,418 | B2 * | 8/2016 | Skrashevskiy | A63B 23/03533 |
| 2007/0179027 | A1 | 8/2007 | Van Straaten | |
| 2010/0062912 | A1 | 3/2010 | Summers | |
| 2012/0258843 | A1 * | 10/2012 | Summers | A63B 21/0603 482/93 |
| 2014/0162860 | A1 * | 6/2014 | Yang | A63B 69/04 482/146 |

OTHER PUBLICATIONS

Written Opinion of the International Search Authority PCT/GB2017/050727 dated May 16, 2017.

PCT International Preliminary Report on Patentability (Chapter I) With Written Opinion from PCT/GB2017/050727 dated Sep. 18, 2018.

* cited by examiner

EXERCISE APPARATUS

CROSS-REFERENCE TO RELATED APPLICATIONS

The present application is the U.S. National Phase of PCT/GB2017/050727 filed on Mar. 16, 2017 which claims priority to UK patent application No. 1604565.0, filed with the United Kingdom Intellectual Property Office on Mar. 17, 2016, which are incorporated herein by reference in their entireties.

The present invention relates to an exercise apparatus/device, and in particular, but not exclusively to such an apparatus for exercising the inner and outer thigh muscles of a user.

A wide variety of exercise apparatus and devices are commonly known for improving the strength and tone of various portions of the human body including in particular the human legs.

One such known device has a particular configuration forming the subject matter of UK Design Registration 3011754 and which presents a pair of footplates arranged for reciprocal movement along commonly aligned downwardly concave rails such that as the user, when in prone position standing on the footplates, moves the footplates reciprocally in the lateral direction the curvature offered by the downwardly convex rails causes the user's body to be raised and lowered in a vertical direction. The lateral movement of the footplates then serves to work against the user's own weight and thereby work, in particular, the thigh muscles of the user's legs.

Also known from published European patent application EP 2 281 609 A is an exercise apparatus/device involving reciprocal motion of the user's legs along parallel and adjacent extending tracks.

The exercise undertaken by the user is solely directed to the legs even though the nature of movement during an exercise routine may also be readily suited to the exercising of other parts, muscles, and muscle groups of the human body.

The present invention seeks to provide for an exercise apparatus/device having further advantageous features over and above known such apparatus/devices. In particular the invention seeks to provide for an exercise apparatus/device arranged for exercising a user's legs but also arranged, in addition or in the alternative, for the working of other muscles, muscle groups, such as, for example, those of the upper torso and upper limbs. In particular, the user can then decide to perform an exercise routine involving just the upper limbs, or legs, or both.

According to the present invention there is provided an exercise apparatus comprising a pair of footplates arranged for movement on respective support means, the support means extending away from a central frame portion of the apparatus, the footplates being arranged to receive a pair of human feet and so as to be moved by a user in a manner in the direction of the support means as part of an exercise routine, and wherein the apparatus incudes handgrip portions mounted on a handlebar arrangement extending from the central frame portion of the apparatus, the handgrip portions being arranged for movement, such as, but not limited to, upward and/or downward movement, relative to the frame portion during the exercise routine.

The invention is particularly advantageous in that, in addition of the leg exercising routine, the apparatus allows for simultaneous and complementary, or alternative, exercising of the upper torso and limbs.

As a particular feature, the nature of exercising of the upper torso and limbs is readily achievable and controlled in a rhythmic manner matching, and synchronised to be in phase with the leg exercise. The whole exercise routine can then be performed in a readily coordinated and rhythmic manner particularly suited to music-based exercise sessions whether at home, at the gym or as part of a group participation class.

Advantageously, the said central frame portion includes an upwardly extending elongate member having an upper end at which the handgrip portions are located. As will be appreciated, the upwardly extending member can comprise a stem member.

As noted, the handgrip portions are provided on, or form part of, a handlebar arrangement which can extend laterally of the central frame portion, or extend forwardly thereof.

The handgrips can be provided for movement against a resilient bias.

Further the handgrip portions can be provided at opposite ends of a unitary member, or can be provided on, or comprise parts of, respective separate members.

In one arrangement, the handgrip portions each connect to the central frame portion by way of a resilient member. The handgrip portions themselves can then be rigid. The resilient member can comprise any appropriate member such as a spring member, although fluid-cavity arrangements such as piston/cylinder arrangements are also envisaged.

In one embodiment, the resilient member can comprise an elongate flexible fibreglass member such as a fibreglass rod.

The handgrip portions can be arranged to pivot, or partially rotate, about a connection to the central frame portion to provide for the said movement. Such pivoting/rotation can be by way of a spring-loaded coupling of the handgrip portion, and member bearing the handgrip portion, to the central frame portion.

Alternatively, or in addition, the handgrip portions, and or any member bearing the handgrip portions, can exhibit inherent resilience. The handgrip portions, and/or any member bearing the handgrip portions, can then be arranged to flex and/or bend to provide for the said upward and/or downward movement.

It can prove a particularly advantageous feature that the said movement of the handgrip portions is restricted substantially to a single plane. In particular, that plane can comprise one with a major vertical component, and so can preferable be orthogonal to the horizontal.

The manner of pivotal/rotatable coupling of the handgrip portions, or the members bearing the handgrip portions, can serve to define the required plane of upward and/or downward movement.

Also, the shape and/or configuration of the handgrip portions, or the members bearing the handgrip portions, can serve to define the required plane of upward and/or downward movement. For example, a resilient elongate handlebar portion can be provided with shallow rectangular transverse cross-section such that it can only flex when in use in the present invention in one plane.

In a further aspect the said resilient bias can advantageously be adjustable in strength and/or stroke of movement. Merely as examples, such adjustability can be provided by adjustment at the point of pivotal/rotatable coupling to the central frame portion; or by adjustment of the location of contact of the resilient member to the central frame portion.

The support means can be arranged to support a footplate for sidewise movement of the user's foot, and/or back and forth movement of the user's toot. It should be appreciated that the invention also envisages multidirectional movement such as, for example, over a circular or oval path.

If required, each footplate can be further arranged to operatively engage at least one exercise weight in manner so as to raise the said weight through a vertical distance during at least one stroke of the said reciprocal movement.

The device can be arranged to receive a selective plurality of weights to allow for the selective variation of the resistance to movement offered during an exercise routine.

In particular, each of the selective plurality s is arranged to be fluid-filled, or sand/particulate-filled.

In one particular aspect, a rigid connector is provided for the operative connection between the footplate and the exercise weight such that, during outward movement of the footplate, the rigid connector and associated weight, extends beyond the said lateral portions of the device.

An advantageous degree of variation can then be imparted to both the leg exerciseand upper torso exercise either alone or in combination.

As will be appreciated, the present invention provides an advantageous adaptation of known leg exerciser apparatus and through which an easily, and accurately, variable adjustment to the resistance offered during an exercise routine can be provided quite independently of the size and weight of the user. The height through which the weight can be moved can also advantageously be enhanced.

The invention is described further hereinafter, by way of example only, with reference to the accompanying drawings in which.

Figure 1:
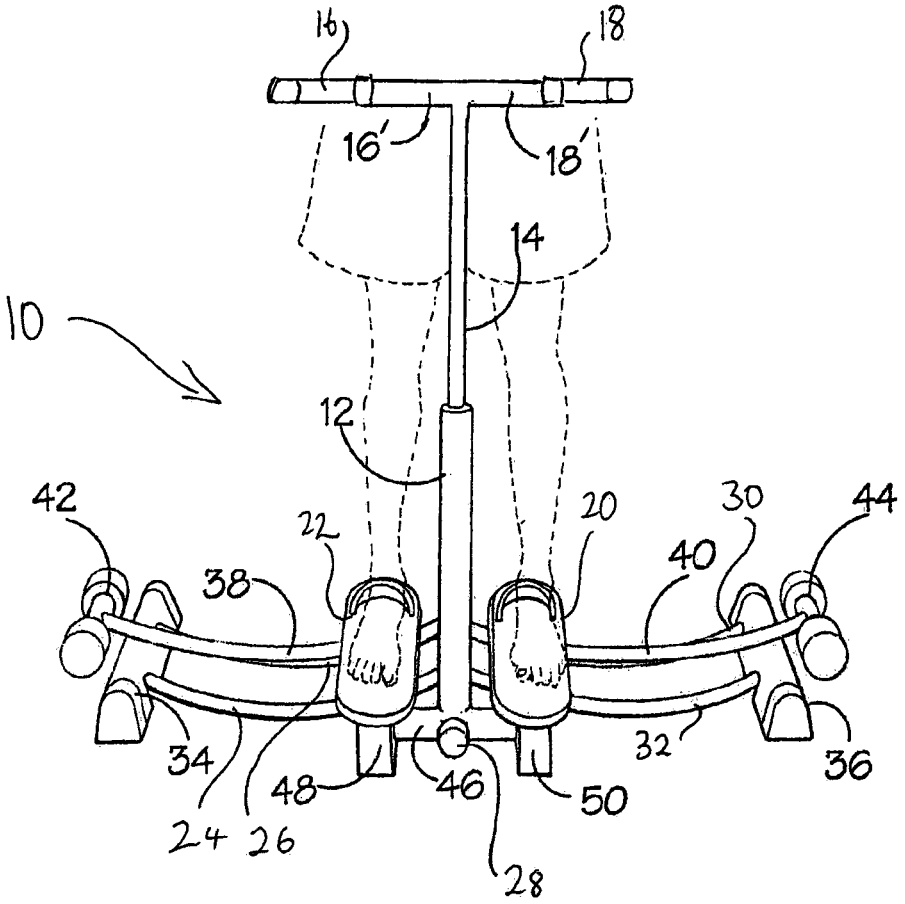
FIG. 1 is a perspective view of an exercise apparatus according to one embodiment of the present invention.

Turning first to FIG. 1 the perspective view of an embodiment of the present invention shows an exerciser 10 having an upstanding telescopic central support 12, 14, as part of a central frame portion, and from the upper end of which extend in a transverse manner a pair of handgrips 16, 18 to be gripped by a user during an exercise routine. The handgrips are each provided on right 16' and left 18' parts of a handlebar formed of a resilient material. Importantly the handlebar portions 16', 18' are allowed to flex against their resilient bias by movement of the user's hands when gripping the handgrips 16, 18 as part of any appropriate exercise routine as discussed further below.

The device 10 further comprises a pair of footplates 20, 22 each arranged to receive a foot of the user and which are movably mounted upon laterally extending support means so as to allow for reciprocal movement of each footplate 20, 22.

The support means for footplate 22 comprise parallel downwardly curved rails 24, 26, and which are connected to a central region 28 of the device 10 and from one end of which extends the central support 12, 14.

Likewise, connected to the central region 28 are a pair of similarly downwardly curved rails 30, 32 upon which the other 20 of the two footplates is movably mounted.

The movable mounting of the footplates 20, 22 to the rails 24, 26; 30, 32 can be provided by any appropriate bearing means/surface as required.

As will be appreciated, the rails 24, 26; 30, 32 extend along a common line from the central region 28, and which common line is substantially perpendicular to the longitudinal extent of each footplate 20, 22.

The ends of the rails 24, 26 remote from the central region 28 of the device 10 are connected to a sidewall member 34 of the device 10, whereas the ends of the rails 30, 32 remote from the central region 28 are mounted to the second sidewall member 36.

As will be appreciated from the following, the sidewall members 34, 36 perform an important function in the illustrated embodiment of the present invention, but likewise provide lateral supports for the secure floor-location of the device 10 when in use.

Operatively connected to each of the footplates 22, 20 is a respective pair of outwardly extending curved support arms 38, 40 which, as illustrated, have a configuration similar to that of each of the rails 24, 26; 30, 32.

Each of the curved support arms 38, 30 is operatively connected to its respective footplate 22, 20 and is provided at its remote end with means for receiving one of a pair of exercise weights 42, 44. It can be appreciated that each of the exercise weights 42, 44, is located adjacent each of the respective side wall members 34, 36 when each footplate 20, 22 is at the end of its inward stroke.

Also, the central portion 28 of the device 10 includes a front end comprising a transverse support arm 46 having a pair of feet 48, 50 and respective ends thereof for further enhancing the floor-mounted stability of the device 10. The apparatus of FIG. 1 is shown at the time a user is about to start an exercise routine with then handle bar portions 16', 18' in their "home", i.e. unstressed position.

Figure 2:
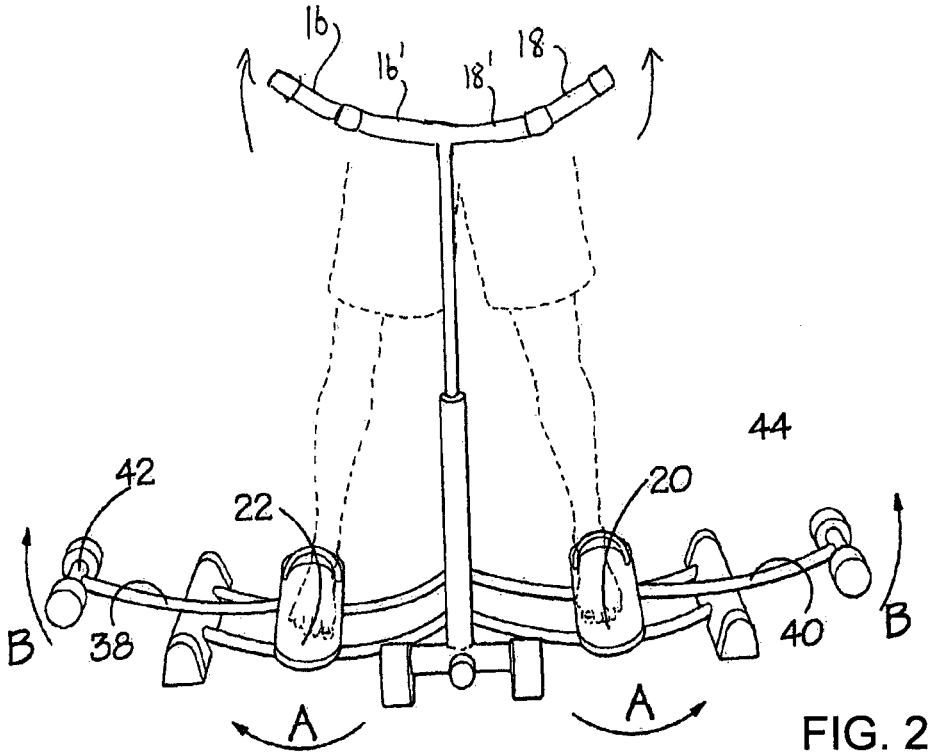
FIG. 2 is a view of the apparatus similar to that of FIG. 1, but showing the handgrips moved upwardly.
Figure 3:
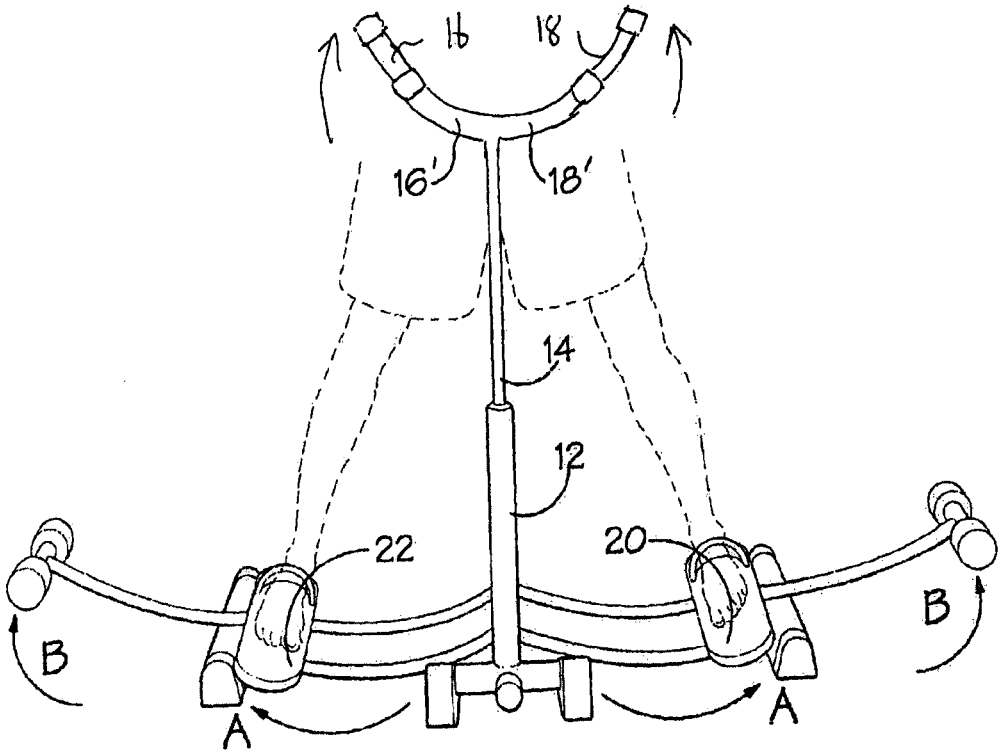
FIG. 3 is a similar view to that of FIG. 2 and showing the handgrips moved upwardly to their maximum extent.

Turning now to FIGS. 2 and 3, use of the device 10 is described as follows.

As mentioned previously, the footplates 20, 22 are arranged for reciprocal movement between the central portion 28 and sidewall members 34, 36 of the device 10 during an exercise routine.

Through employment of the downwardly curved tracks 24, 26; 30, 32 the user's body is repeatedly raised and lowered such that the leg muscles causing the reciprocal outward and inward movement of the footplates 20, 22 work against the user's body weight.

In addition, and through the gripping by the user of the hang grips 16, 18, the handlebar portions 16', 18' are bent/flexed upwardly against their bias as shown. This occurs as the footplates 20, 22 are moved outwardly a s shown by arrows A.

FIG. 3 shows the maximum extent of the stroke of outward movement of the footplates 20, 22, and simultaneous upward movement of the handgrips 16, 18. Also, and through the rigid connection offered by the curved arms 38, 40 to the respective weights 42, 44, those weights 42, 44 are likewise moved along a curved path indicated by arrows B.

Due to the length and configuration of the arms 38, 40 it will be appreciated that the vertical distance moved by the weights 42, 44 during the outward stroke of the footplates 20, 22 in the direction of the arrows A is in fact far greater than the vertical distance moved by the footplates 20, 22.

This advantageously increases and enhances the a nt of work undertaken by the user's legs during an exercise routine.

Figure 4:
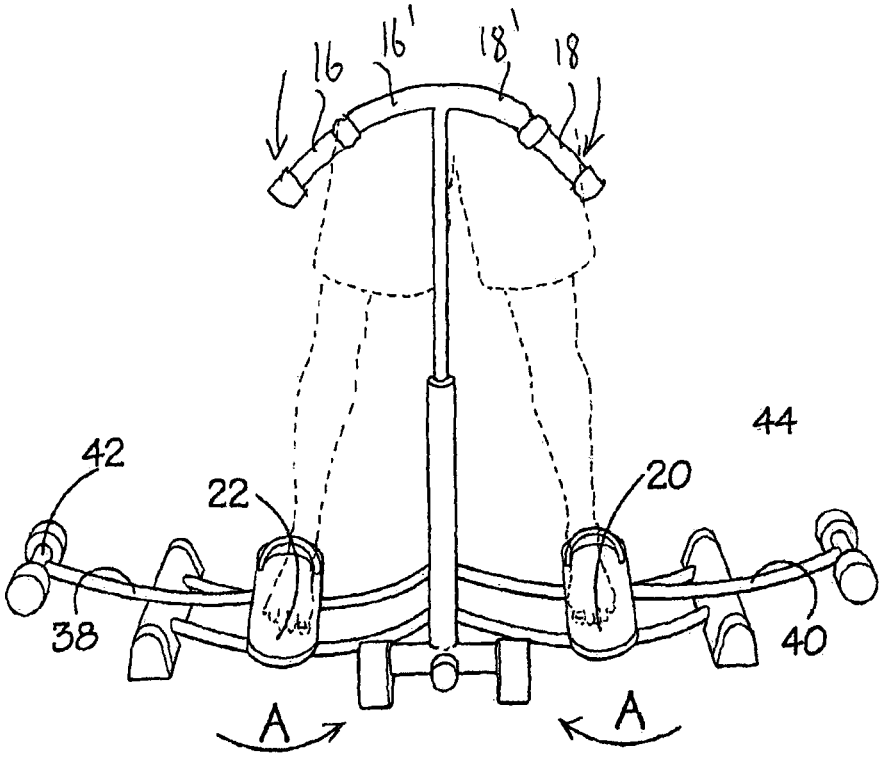
FIG. 4 is a view similar to that of but showing the handgrips moved downwardly to their maximum extent.

The next stroke of movement in the exercise routine involves movement of the footplates 20, 22 inwardly, and the simultaneous flexing/bending of the handlebar portions 16', 18' downwardly as shown in FIG. 4.

The movements between the positions illustrated in FIGS. 3 and 4 are then repeated as quickly and as often as required by the exercise routine. Of course, it should be appreciated that the apparatus need not include the weights and associated connections 38, 40 and such absence of these features can lead to a simplified construction, and simplified and possible quicker operation and thus different style of exercise routine.

Figure 5:
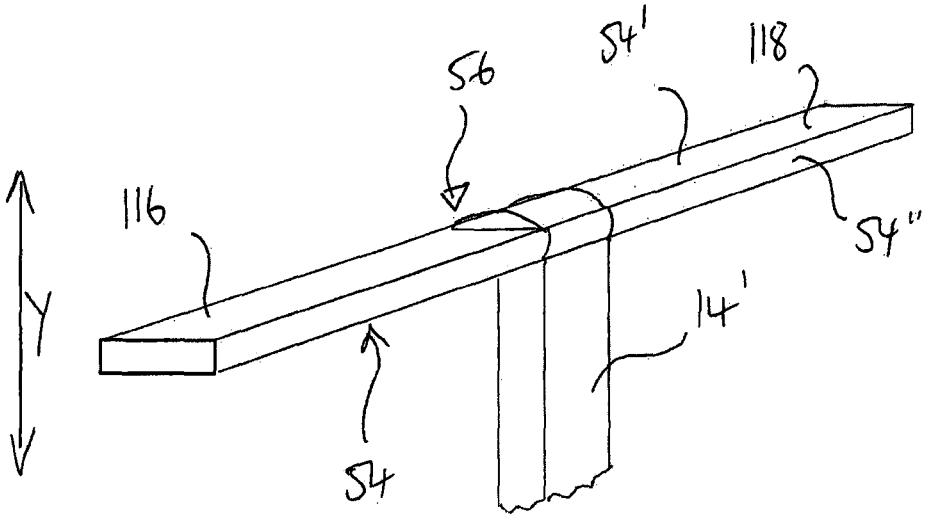
FIG. 5 is a perspective view of one example of a handgrip portion of apparatus according to an embodiment of the present invention.
Figure 6:
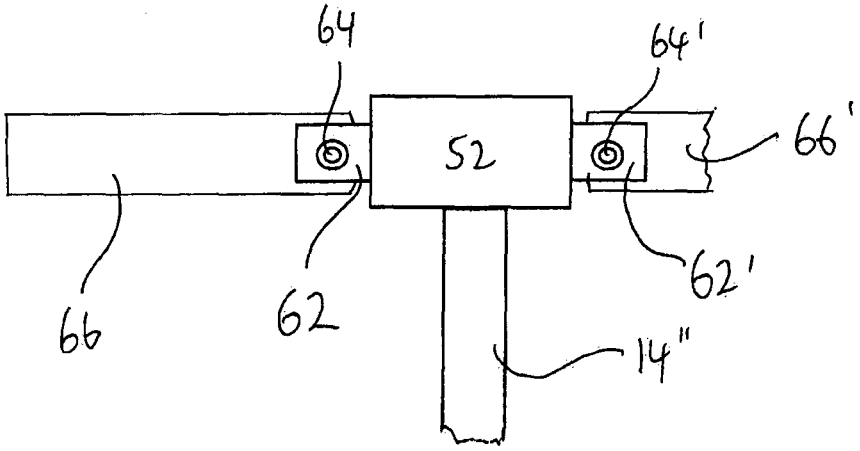
FIG. 6 is a perspective view of another example of a handgrip portion of apparatus embodying the present invention.

It should of course be appreciated that the required movement of the handgrips can be facilitated in any appropriate manner, through choice of resilient flexible material, and/or nature of resilient coupling. FIGS. 5 and 6 illustrate just two of many possible examples.

FIG. 5 is a perspective partial view of an embodiment of the present invention showing just the upper end of a rectilinear stem 14' of a central frame portion of the exercise apparatus, and its associated handgrips 116, 118 which comprise the lateral ends of a flexible rectilinear handlebar 54. The stem 14' terminates at its upper end in handlebar connector 56. It should be appreciated that the handlebar can be formed as in this example as a single member, or as respective right and left members each connected to the connector 56, As illustrated, the relative dimensions of the upper face 54' and the side face 54" of the rectilinear handlebar 54 are such as to form a shallow rectangular transverse cross-section. This helps determine that the handgrip can only flex in the direction of the vertical plane indicated by arrow Y, and not in the horizontal plane.

Limiting the plane of movement in this manner proves advantageous in enhancing the exercise routine in a manner in which the stability of the apparatus, and of the user on the apparatus is not compromised.

FIG. 6 illustrates another example of a handgrip portion of apparatus embodying the present invention.

Illustrated again here is part of a stem 14" terminating at its upper end in a stem head 52 and from left and right sides of-which extend left and right lugs 62, 62'. The lugs include spring pivot couplings 64, 64' by-which respective rigid handgrips 66, 66' (66' shown in part) are mounted to the stem 14" in a resilient manner. Rather than flexing therefore in the manner of the example of FIG. 5, the handgrips 66, 66' of FIG. 6 achieve their upward and downward movement in the required manner in a pivotal/part rotatable fashion against the bias offered by the spring coupling 64, 64'.

Of course the degree and ease of movement of the handgrips of the present invention can be readily varied by variation of the mode/manner of connection to the stem. For an arrangement such as that of FIG. 5, the length of handlebar extending beyond the connector 56 can serve to determine the degree and/or ease of flexing. As for embodiments such as FIG. 6, the type and strength of the spring of the spring coupling 64 can be and selected as appropriate.

Figure 7:
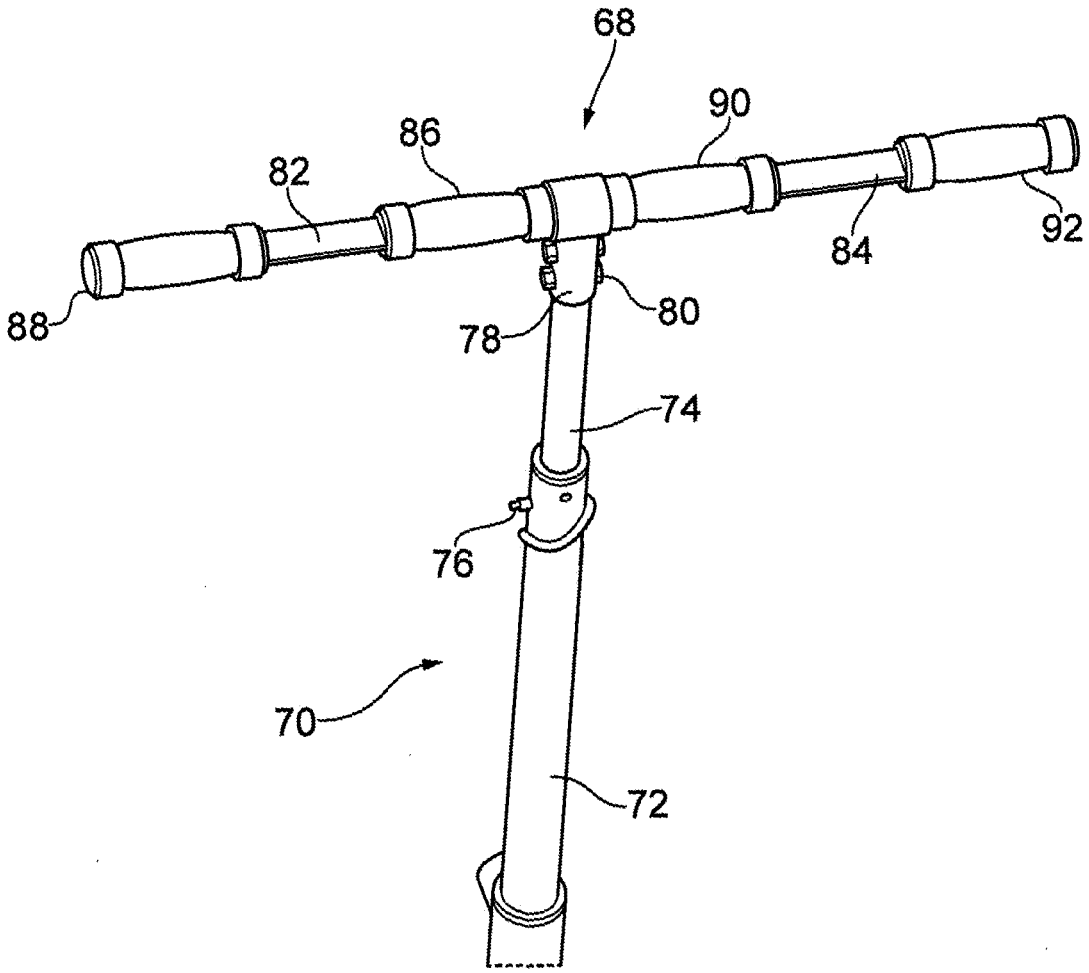
FIG. 7 is a perspective view of part of the handlebar region of a further embodiment of the present invention.

Turning now to FIG. 7, there is illustrated the handlebar region 68 of a further embodiment of exercise apparatus of the invention and which comprises a particularly simplified arrangement comprising a central upstanding stem portion 70 of the frame and including telescoping sections 72, 74 allowing for secured adjustment in the height of the handlebar by means of a locking pin 76 arranged for receipt in aligned apertures through the walls of the sections 72, 74. The handlebar region 68 includes a downwardly depending central lug 78 mounted in secure fashion by means of bolts 80 to the upper end of the stem section 74. Connected to, or formed integrally with, the central lug 78 is a rectilinear bar having left 82, and right 84, extending sections which form the handlebar. The left and right sections 82, 84 can comprise respective ends of a common member, or separate members connected together in the region of the central lug 78. If separate members, each can offer a different characteristic of resilient distortion from the other if desired, perhaps for flexibility/adaptability of exercise routine. Mounted to each of the handlebar sections 82, 84 is a pair of ergonomic, for example foam, handgrips. The left section 82 has inner 86, and outer 88, handgrips; and the right section 84 has inner 90 and outer 92 handgrips. The handgrips can be gripped by a user in any combination required, for example, just the outer pair 88, 92; just the inner pair 86, 90; an inner on one side and an outer on the other side; or just one of the handgrip(s) on one of the sides only.

As an alternative, but not suggested by FIG. 7, only a single handgrip is provided on each of the left 84 and right 86 sections of the handlebar but whose position can be selectively adjusted along the length of the handlebar section between inner and outer positions either prior to, or during, an exercise routine.

Extending upwardly from the central frame portion 70 is a stem member 80, adjustable in height, and which is provided at its upper end with handlebar arrangement in the form of a handlebar 82. It should be appreciated that the handlebar 82 can be formed integral with, or connected to, the stem 80.

Figure 8:
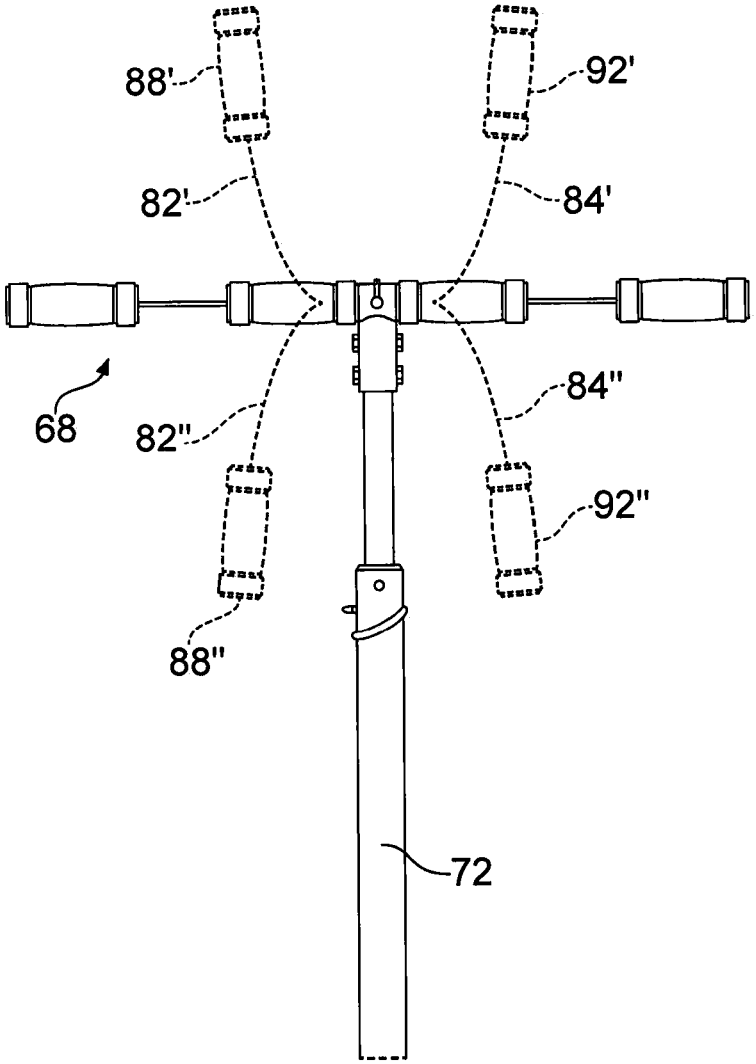
FIG. 8 is a front elevational view of the part of FIG. 7 and including a schematic representation of the movement in the vertical plane during an exercise routine.

Turning lastly to FIG. 8, there is provided a plan elevational view of the handlebar region 68 of FIG. 7. In addition to the handlebar at rest, FIG. 8 shows schematically an upward resilient deformation of the handlebar and its component parts 82', 84', 88', 92'; and a downward resilient deformation 82", 84", 88", 92"—all as occurring as part of an exercise routine. For clarity only handgrips 88', 88", 92', 92" in outer locations are shown with the handlebar deformed upwardly and downwardly.

The handlebar configuration of FIGS. 7 and 8 can be provided in relation to any embodiment of the invention, irrespective of the nature and/or direction of movement of the foot rests, and whether or not they have weights associated therewith. A particularly simplified arrangement employs footrests without any additional weight/resistive features.

It should of course be appreciated that the invention is not restricted to the details of the foregoing embodiments. For example, the support means for the footplates can extend in any required direction away from the central portion and can follow any appropriate path as required, whether along a flat trajectory or otherwise. Also, the handgrip portions can be of any appropriate shape/configuration and be mounted on, or form part of, handlebar portions likewise having any appropriate shape/configuration.

The invention claimed is:

1. An exercise apparatus comprising a pair of footplates arranged for movement on respective supports, the supports extending away from a central frame portion of the apparatus, the pair of footplates being configured to receive a pair of human feet and so as to be moved by a user in a manner in the direction of the supports as part of an exercise routine, and wherein the apparatus includes handgrip portions mounted on a handlebar arrangement extending from the central frame portion of the apparatus, the handgrip portions being arranged for movement relative to the frame portion during the exercise routine wherein the said movement of the handgrip portions is restricted to a single plane of movement and said single plane of movement comprises one with a major vertical component.

2. The exercise apparatus as claimed claim 1, wherein the handgrip portions are arranged for movement against a resilient bias during the exercise routine.

3. The exercise apparatus as claimed in claim 2, wherein said resilient bias is adjustable in strength and/or stroke of movement.

4. The exercise apparatus as claimed in claim 3, wherein said adjustability of the resilient bias is provided by resilient pivot coupling to the central frame portion.

5. The exercise apparatus as claimed in claim 2, wherein said resilient bias is determined by a length of the resilient member between the handgrip portions and the central frame portion.

6. The exercise apparatus as claimed in claim 2, wherein any of said handgrip portions, and said handlebar arrangement extending from the central frame portion of the apparatus, exhibit inherent resilient bias.

7. The exercise apparatus as claimed in claim 6, wherein any of said handgrip portions, and said handlebar arrangement extending from the central frame portion of the apparatus, are arranged to flex and/or bend to provide for the said movement.

8. The exercise apparatus as claimed in any one or more of the preceding claims, wherein each of the pair of footplates are further arranged to operatively engage at least one exercise weight in manner so as to raise the said at least one exercise weight through a vertical distance during at least one stroke of the said reciprocal movement.

9. The exercise apparatus as claimed in claim 8, and arranged to receive a further selective plurality of weights to allow for selective variation of a resistance to movement offered during an exercise routine.

10. The exercise apparatus as claimed in claim 8, wherein the at least one exercise weight is fluid-filled.

11. The exercise apparatus as claimed in claim 8, wherein a rigid connector is provided for operative connection between the pair of footplates and the at least one exercise weight such that, during outward movement of the pair of footplates, the rigid connector and at least one exercise weight extends beyond the said lateral portion of the device.

12. The exercise apparatus as claimed in claim 1, wherein the handlebar arrangement extends laterally of the central frame portion.

13. The exercise apparatus as claimed in claim 12, wherein the handlebar arrangement is adjustable between a forward and lateral directions of extension.

14. The exercise apparatus as claimed claim 1, wherein the handgrip portions each connect to the central frame portion via a resilient member.

15. The exercise apparatus as claimed in claim 14, wherein the resilient member comprises a spring member.

16. The exercise apparatus as claimed in claim 1, wherein the handgrip portions are arranged to pivot, or partially rotate, about a connection to the central frame portion to provide for the said movement.

17. The exercise apparatus as claimed in claim 16, wherein the said handgrip portions are arranged to pivot, or partially rotate by way of a spring-loaded coupling of the handgrip portion, or a member bearing the handgrip portion, to the central frame portion.

18. The exercise apparatus as claimed in claim 1, wherein the supports define a sideways path of motion of the pair of footplates.

19. The exercise apparatus as claimed in claim 1, wherein the supports define a back-and-forth path of motion of the pair of footplates.

20. The exercise apparatus as claimed in claim 1, wherein the supports define a multi-directional path of motion of the pair of footplates.

21. The exercise apparatus as claimed in claim 1, wherein the handlebar arrangement extends at least to some extent forwardly or backwardly of the central frame portion.

22. The exercise apparatus as claimed in claim 1, wherein said handlebar arrangement extending from the said central frame portion includes an upwardly extending elongate member having an upper end at which the handgrip portions are located.

23. The exercise apparatus as claimed in claim 1, wherein the handgrip portions are provided at opposite ends of a unitary member, the unitary member being included in the handlebar arrangement.

24. The exercise apparatus as claimed in claim 1, wherein the handgrip portions are provided on, or comprise parts of, respective separate members, said separate members being included in the handlebar arrangement.

25. The exercise apparatus as claimed claim 1, wherein the handgrip portions are configured for repetitive motion during the said movement.

26. The exercise apparatus as claimed in claim 1, wherein said single plane is orthogonal to a horizontal.

27. The exercise apparatus as claimed in claim 1, wherein the arrangement of said handgrip portions allowing them to pivot and/or partially rotate, or of said handlebar arrangement extending from the central frame portion of the apparatus, serves to define said plane of movement.

28. The exercise apparatus as claimed in claim 1, wherein a shape and/or configuration of the handgrip portions, or the handlebar arrangement bearing the handgrip portions, serve to define said plane of movement.

* * * * *